US010273901B2

(12) United States Patent
Fluharty et al.

(10) Patent No.: US 10,273,901 B2
(45) Date of Patent: Apr. 30, 2019

(54) CAM CARRIER INSERT

(71) Applicant: Ford Global Technologies, LLC, Dearborn, MI (US)

(72) Inventors: Jeff D. Fluharty, Woodhaven, MI (US); Forest Heggie, LaSalle (CA); Robert Stephen Furby, Novi, MI (US); Daniel Nelson, Macomb, MI (US); John Christopher Riegger, Ann Arbor, MI (US); Jeffrey Thomas Lacroix, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 62 days.

(21) Appl. No.: 15/453,828

(22) Filed: Mar. 8, 2017

(65) Prior Publication Data

US 2018/0258879 A1 Sep. 13, 2018

(51) Int. Cl.

| | |
|---|---|
| ***F01L 1/34*** | (2006.01) |
| ***F02F 1/24*** | (2006.01) |
| ***F01L 1/053*** | (2006.01) |
| ***F01L 13/00*** | (2006.01) |
| ***F02F 7/00*** | (2006.01) |
| *F01L 1/18* | (2006.01) |

(Continued)

(52) U.S. Cl.

CPC ..... *F02F 1/24* (2013.01); *F01L 1/053* (2013.01); *F01L 13/0005* (2013.01); *F02F 7/006* (2013.01); *F01L 1/185* (2013.01); *F01L 1/2405* (2013.01); *F01L 1/34* (2013.01); *F01L 2001/0476* (2013.01); *F01L 2001/0537* (2013.01); *F01L 2001/186* (2013.01); *F01L 2001/467* (2013.01); *F01L 2013/001* (2013.01); *F01L 2105/00* (2013.01); *F01L 2800/08* (2013.01)

(58) Field of Classification Search

CPC ... F02F 1/24; F02F 7/006; F01L 1/053; F01L 1/34; F01L 13/0005; F01L 2001/0537; F01L 2001/0476; F01L 2001/186; F01L 2001/467; F01L 2013/001; F01L 2800/08

See application file for complete search history.

(56) References Cited

U.S. PATENT DOCUMENTS

| | | | |
|---|---|---|---|
| 5,617,818 | A | 4/1997 | Lueders |
| 6,276,320 | B1 | 8/2001 | Fujii et al. |

(Continued)

FOREIGN PATENT DOCUMENTS

| | | |
|---|---|---|
| EP | 1895111 B1 | 4/2012 |

*Primary Examiner* — Zelalem Eshete

(74) *Attorney, Agent, or Firm* — Julia Voutyras; McCoy Russell LLP

(57) ABSTRACT

Methods and systems are provided for a cam carrier insert coupled to a cylinder head of an engine. In one example, a system may comprise: a cylinder head with a cam bearing tower; a cam carrier insert positioned in the cylinder head; and a camshaft, the camshaft directly supported by the cam bearing tower and directly supported by the cam carrier insert. By mounting a first portion of the cam shaft to the cam bearing tower and a second portion of the cam shaft on the cam carrier insert, the system may operate deactivatable and non-deactivatable intake or exhaust valves of one or more engine cylinders in the engine. In this way, packaging of engine components within the cylinder head may be improved while promoting better engine performance.

20 Claims, 11 Drawing Sheets

(51) Int. Cl.

| | |
|---|---|
| *F01L 1/24* | (2006.01) |
| *F01L 1/047* | (2006.01) |
| *F01L 1/46* | (2006.01) |

(56) References Cited

U.S. PATENT DOCUMENTS

| | | | | |
|---|---|---|---|---|
| 8,302,574 | B2 | 11/2012 | Ahn | |
| 8,820,277 | B2 | 9/2014 | Moon et al. | |
| 8,887,694 | B2 * | 11/2014 | Hada | F02M 39/02 123/495 |
| 8,931,444 | B2 | 1/2015 | McConville et al. | |
| 2007/0215074 | A1 | 9/2007 | Rozario et al. | |
| 2010/0192887 | A1 * | 8/2010 | Iwata | F01L 1/022 123/90.17 |
| 2011/0155084 | A1 | 6/2011 | Sargeant | |
| 2011/0220049 | A1 * | 9/2011 | Staley | F01L 1/053 123/90.34 |
| 2014/0137819 | A1 * | 5/2014 | McConville | F01L 13/0036 123/90.6 |
| 2014/0190450 | A1 | 7/2014 | Uemizu | |
| 2016/0177867 | A1 | 6/2016 | Wicks et al. | |
| 2016/0177868 | A1 | 6/2016 | Wicks et al. | |

* cited by examiner

CAM CARRIER INSERT

FIELD

The present description relates generally to methods and systems for a cam carrier insert mountable to a cylinder head of an engine.

BACKGROUND/SUMMARY

A cylinder head may be configured with cam bearing towers to support various engine components such as cam shafts, a fuel pump pedestal and a variable displacement engine mechanism. The cam bearing towers may connect to side walls of the cylinder head to form a rigid support structure having bearing portions that support the cam shaft and fuel pump pedestal. Further, a variable cam timing mechanism may be supported by the cam bearing towers. Alternatively, a cam carrier may be mounted to the cylinder head to support cam shafts and other engine components. The cam carrier may be directly mounted to the cylinder head via a plurality of fasteners to minimize movement and vibration of the assembly.

An example system comprising a plurality of cam carriers mountable to a cylinder head of an engine is shown by Okamoto in EP 1,895,111. Therein, the plurality of cam carriers are mountable to the cylinder head via a plurality of fasteners, each cam carrier having bearing portions to support portions of two cam shafts. The cam shafts are mounted to the cam carriers and secured in place using cam caps and fasteners extended through each cap and the cylinder head.

However, the inventors herein have recognized potential issues with such a system. As one example, the cam carriers are not configured to support a variable displacement engine mechanism for operating deactivatable intake and exhaust valves of particular cylinders in the engine. Further, the cylinder head may not have adequate space for mounting additional engine components, such as a cylinder head cap for mounting a fuel pump.

In one example, the issues described above may be addressed by a system comprising: a cylinder head with a cam bearing tower; a cam carrier insert positioned in the cylinder head; and a camshaft, the camshaft directly supported by the cam bearing tower and directly supported by the cam carrier insert. In this way, the cam carrier insert may include bearing portions that support a variable displacement engine (VDE) mechanism, an intermediate cap and a cam shaft. The VDE mechanism may operate deactivatable intake and exhaust valves of one or more cylinders in the engine.

In other examples, a plurality of cam carrier inserts may be mounted to the cylinder head, each cam carrier supporting a VDE mechanism that operates deactivatable intake and exhaust valves of one or more cylinders mounted in a cylinder block coupled to the cylinder head. Each cam carrier insert may support first portions of a cam shaft coupled to the deactivatable intake and exhaust valves of one or more cylinders. Further, second, different, portions of the cam shaft that couple to non-deactivatable intake and exhaust valves of the cylinders, may be directly mounted to cam bearing towers on the cylinder head. In this way, the system may confer several advantages. For example, the deactivatable intake and exhaust valves in one or more cylinders, may be deactivated by the VDE mechanism coupled to the cam carrier insert while the non-deactivatable intake and exhaust valves of the remaining cylinders remain in operation. In this way, packaging of engine components within the cylinder head may be improved while promoting better engine performance. Further, different engine architectures, such as VDE or an engine without VDE, may be achieved by inserting an appropriate cam carrier insert. For example, without the cam carrier insert, additional machining of the cylinder head may occur.

In further examples, the cam carrier insert may be used with any one cylinder or any combination of cylinders in the engine. In other examples, the cam carrier insert may be used in systems where cam journals are positioned over a cylinder head bolt. In this way, more room may be provided for other engine components such as valve train assemblies coupled to the cylinder head or other engine assembly. In addition, or in alternative examples, the cam carrier insert may be used in combination with a fuel pump or a variable valve lift system. In addition or in an alternative approach, a high pressure fuel pump for supplying fuel to one or more cylinders in the engine, may be coupled to the cam carrier insert. In this way, the cam carrier insert may provide a way of adequately securing the fuel pump to the engine while providing bearing support to other engine components.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-11 are shown approximately to scale, although other relative dimensions may be used, if desired.

DETAILED DESCRIPTION

Figure 1:
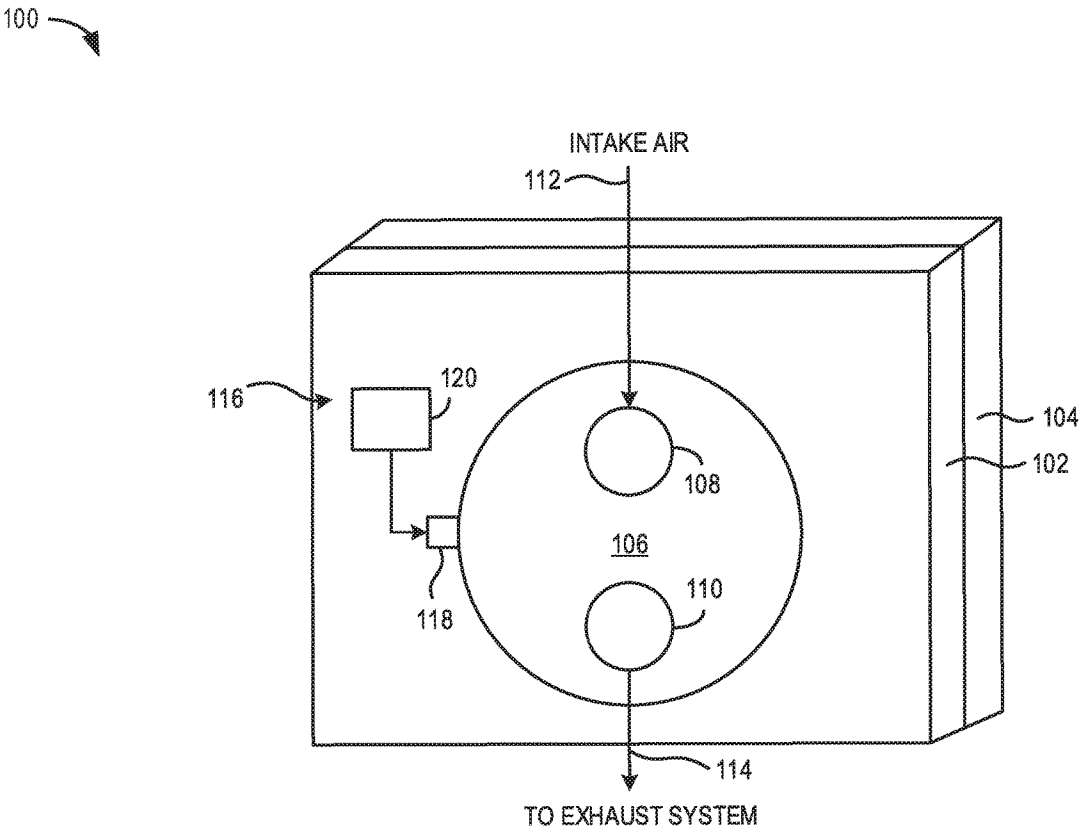
FIG. 1 shows a schematic depiction of an engine system comprising a cylinder head mounted to a cylinder block.
Figure 2:
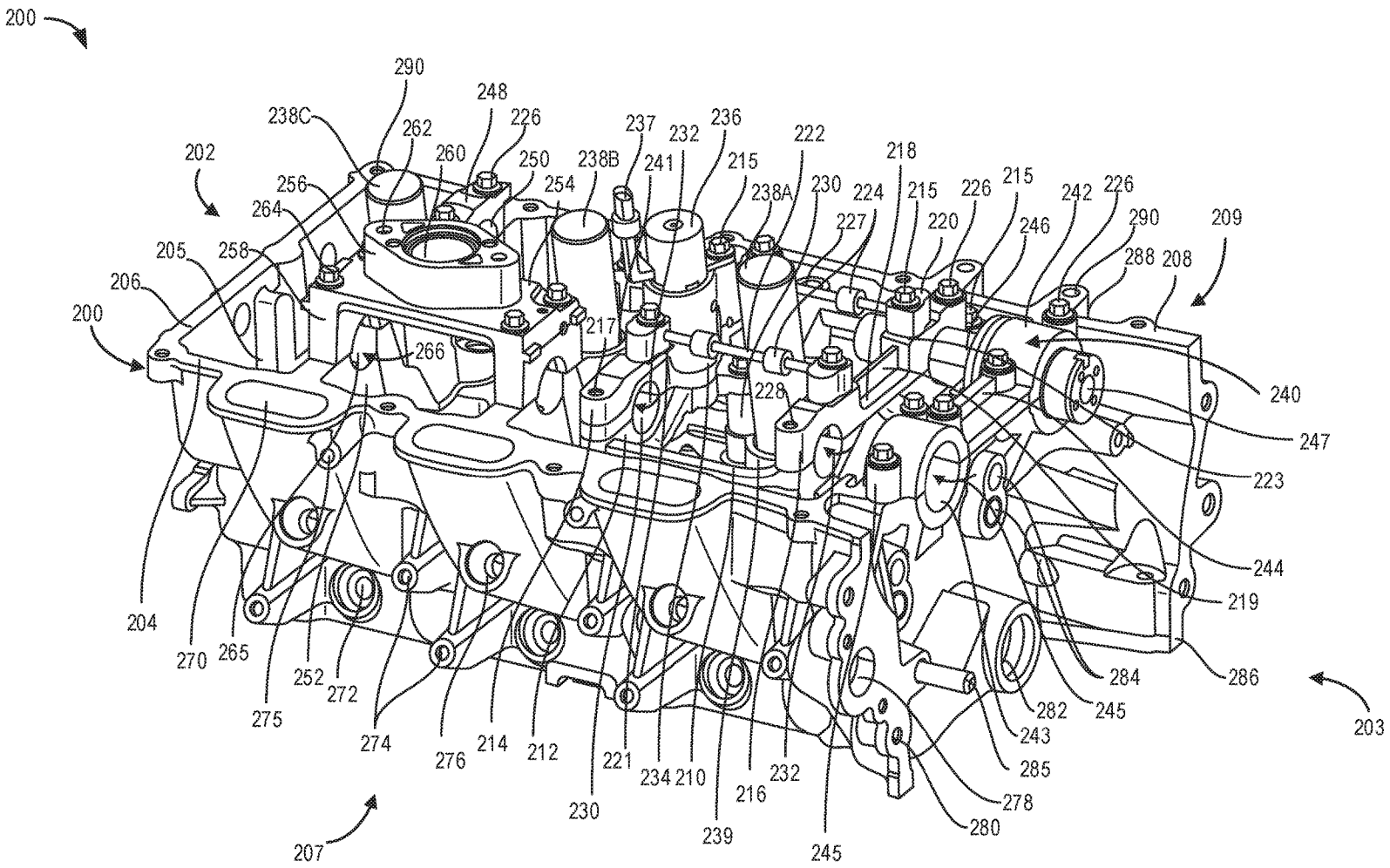
FIG. 2 shows a schematic depiction of a cam carrier insert mounted to a first embodiment of a cylinder head of the engine.
Figure 3:
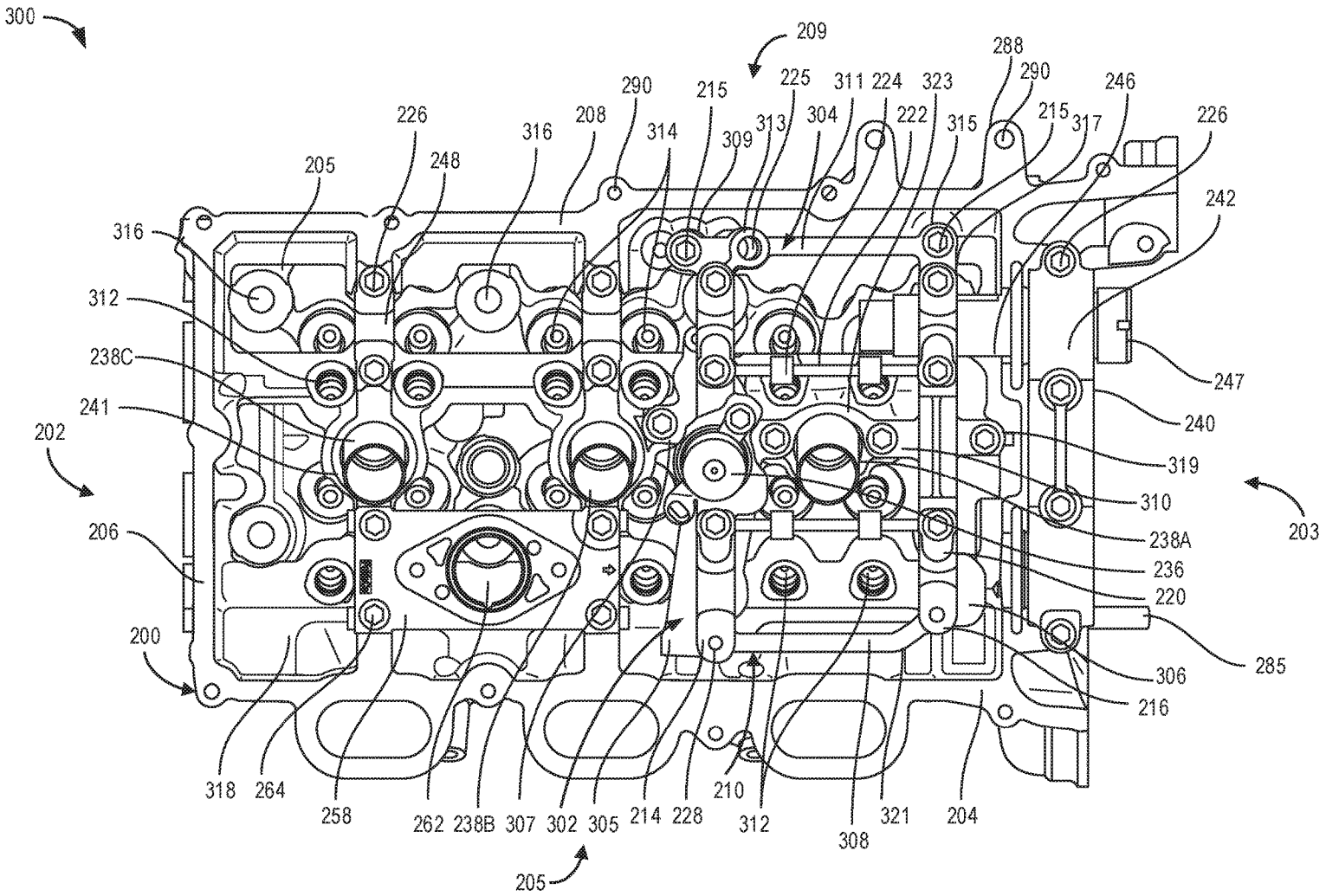
FIG. 3 shows a plan view of the first embodiment of the cylinder head, with the cam carrier insert mounted to an interior compartment of the cylinder head.
Figure 4:
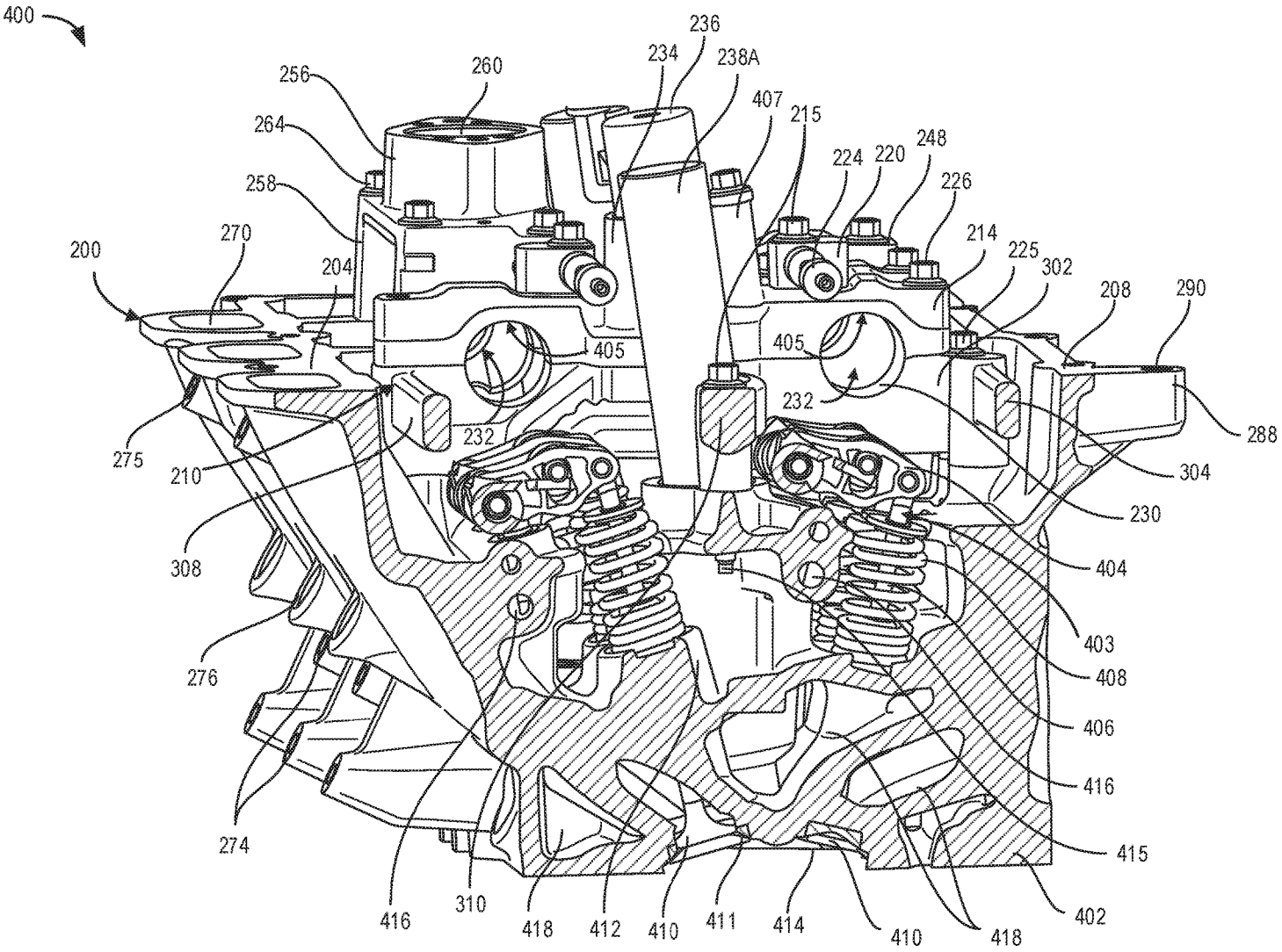
FIG. 4 shows a cross sectional view of the cam carrier insert and valve assemblies mounted to the first embodiment of the cylinder head.
Figure 5:
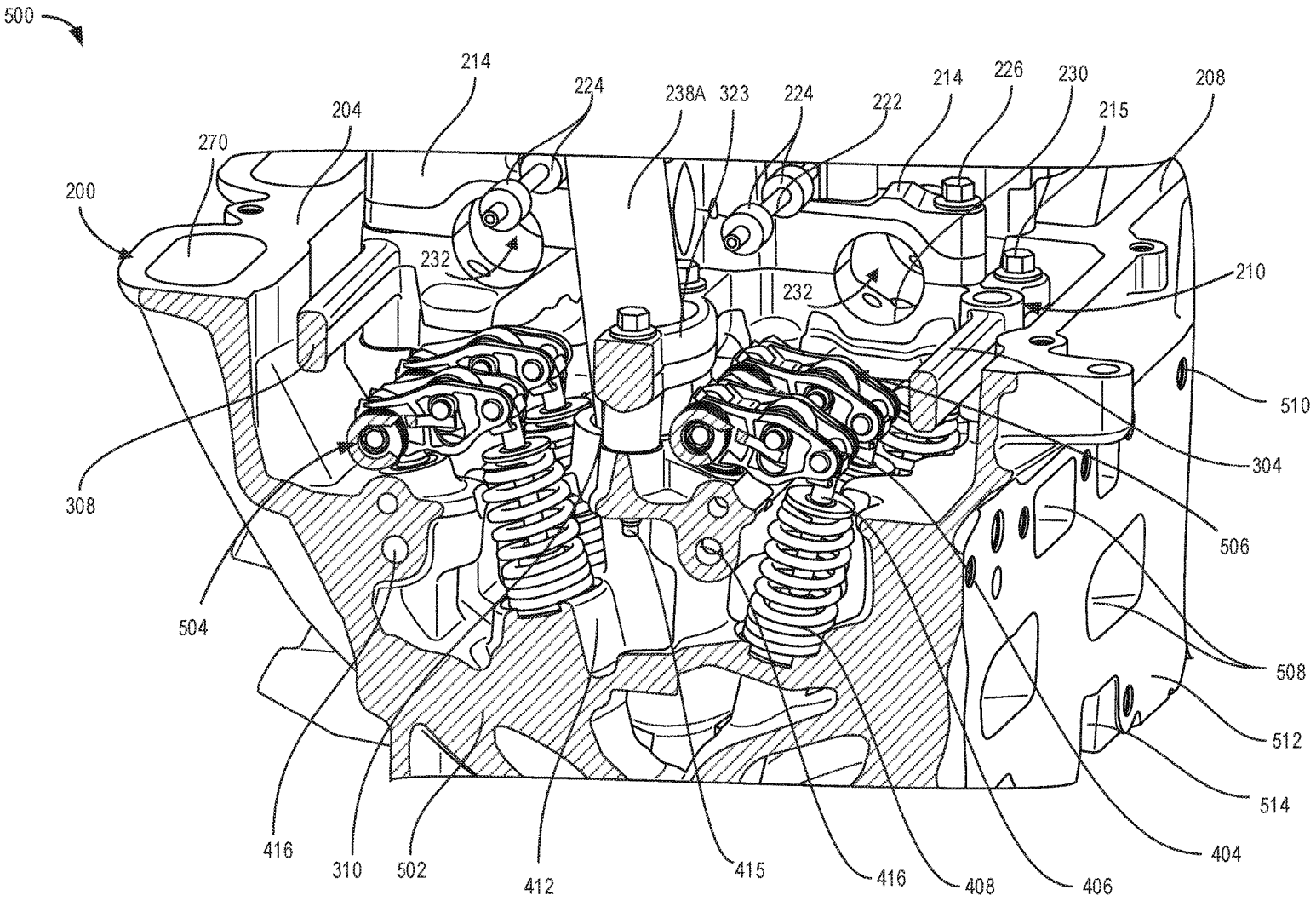
FIG. 5 shows an alternative cross sectional view of the cam carrier insert and valve assemblies mounted to the first embodiment of the cylinder head.

The following description relates to systems for a cam carrier insert coupled to a cylinder head of an engine. The cam carrier insert may be mounted to the cylinder head to provide bearing support for a variable displacement engine (VDE) mechanism and a cam shaft coupled to a variable control timing (VCT) mechanism. As shown in FIG. 1, the engine may include the cylinder head coupled to a cylinder block. A first embodiment of a cylinder head may include cam bearing towers, cam carrier insert, a cylinder head cap and other engine accessories, as shown in FIG. 2. The cam bearing towers may connect to external walls of the cylinder head, and each bearing tower may have a bearing portion to support a section of the cam shaft. Support members of the cylinder head cap may be coupled to the cam bearing towers, to secure the cam shaft to the cylinder head. The cylinder head cap may also include a raised portion having an outer surface that may be coupled to a flange of a fuel pump. In this way, the cylinder head cap enables the fuel pump to be coupled to the cylinder head. When mounted to the cylinder head, the cam carrier insert may support a VDE cap and a VCT cap, as shown in FIGS. 3-5. The VDE cap may include a plurality of arched slots and a tube for mounting a solenoid valve of the engine. The VCT cap may also have a plurality of arched slots, similar to arched slots in the VDE cap. When coupled to the cam carrier insert, the arched slots in the VDE and VCT caps, may align with bearing portions on the cam carrier insert to form openings for the cam shaft. When mounted to the cylinder head, the cam shaft may be in face-sharing contact with the bearing portions on the cam carrier insert. In this way, the cam carrier insert may be mounted to the cylinder head to support the VDE and VCT caps, and portions of the cam shaft.

The cylinder head may also include a plurality of valve assemblies coupled to intake and exhaust ports of cylinders mounted in the cylinder block attached to the head. The valve assemblies may be adjusted to control intake of air through intake ports of the cylinders of the engine, and outflow of exhaust gas through exhaust ports of the cylinders during engine operation. A first and a second group of valve assemblies may include non-deactivatable intake and exhaust valves of cylinders in the engine. The first and second group of valve assemblies may be configured to control intake of air through the non-deactivatable intake ports in the cylinders, and control outflow of exhaust gas through the non-deactivatable exhaust ports of the cylinders. A third group of valve assemblies may include deactivatable intake and exhaust valves of one or more cylinders in the engine. The third group of valve assemblies may be mounted adjacent to the cam carrier insert to control air intake through the deactivatable intake ports in the cylinders, and control outflow of exhaust gas through the deactivatable exhaust ports in the cylinders. In this way, first portions of the cam shaft mounted adjacent to bearing portions on the cam carrier insert may control deactivatable intake and exhaust valves of a first group of cylinders while second, different, portions of the cam shaft adjacent to the bearing towers may control non-deactivatable intake and exhaust valves of a second group of cylinders in the engine. By coupling the VDE mechanism on the cam carrier insert, the intake and exhaust valves of designated cylinders in the engine may be deactivated while the non-deactivatable intake and exhaust valves of the remaining cylinders may remain in operation. In this way, packaging of engine components within the cylinder head may be improved while promoting better engine performance.

Figure 6:
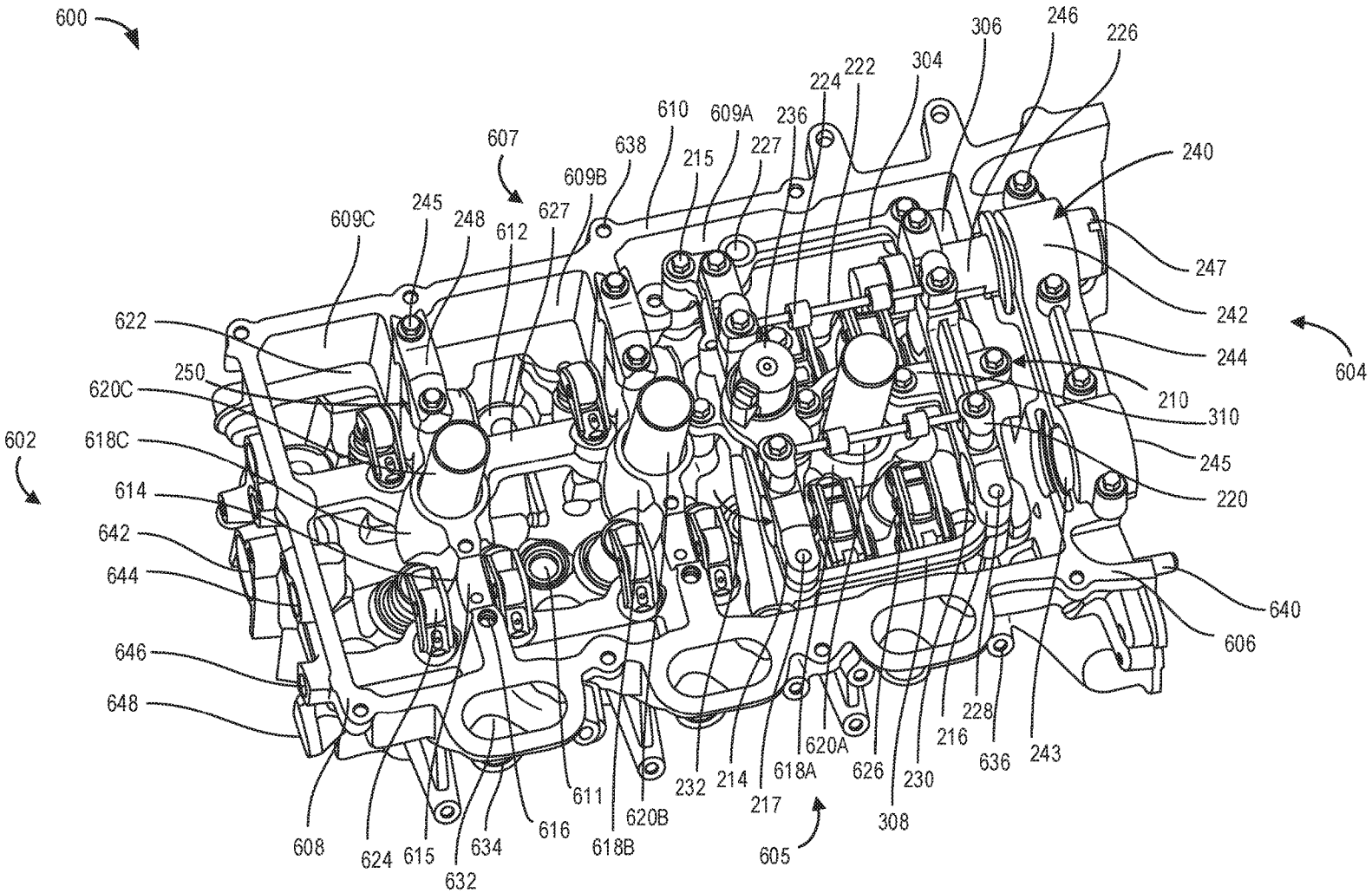
FIG. 6 shows a schematic view of a second embodiment of a cylinder head, with the cam carrier insert mounted to an interior compartment of the cylinder head.
Figure 7:
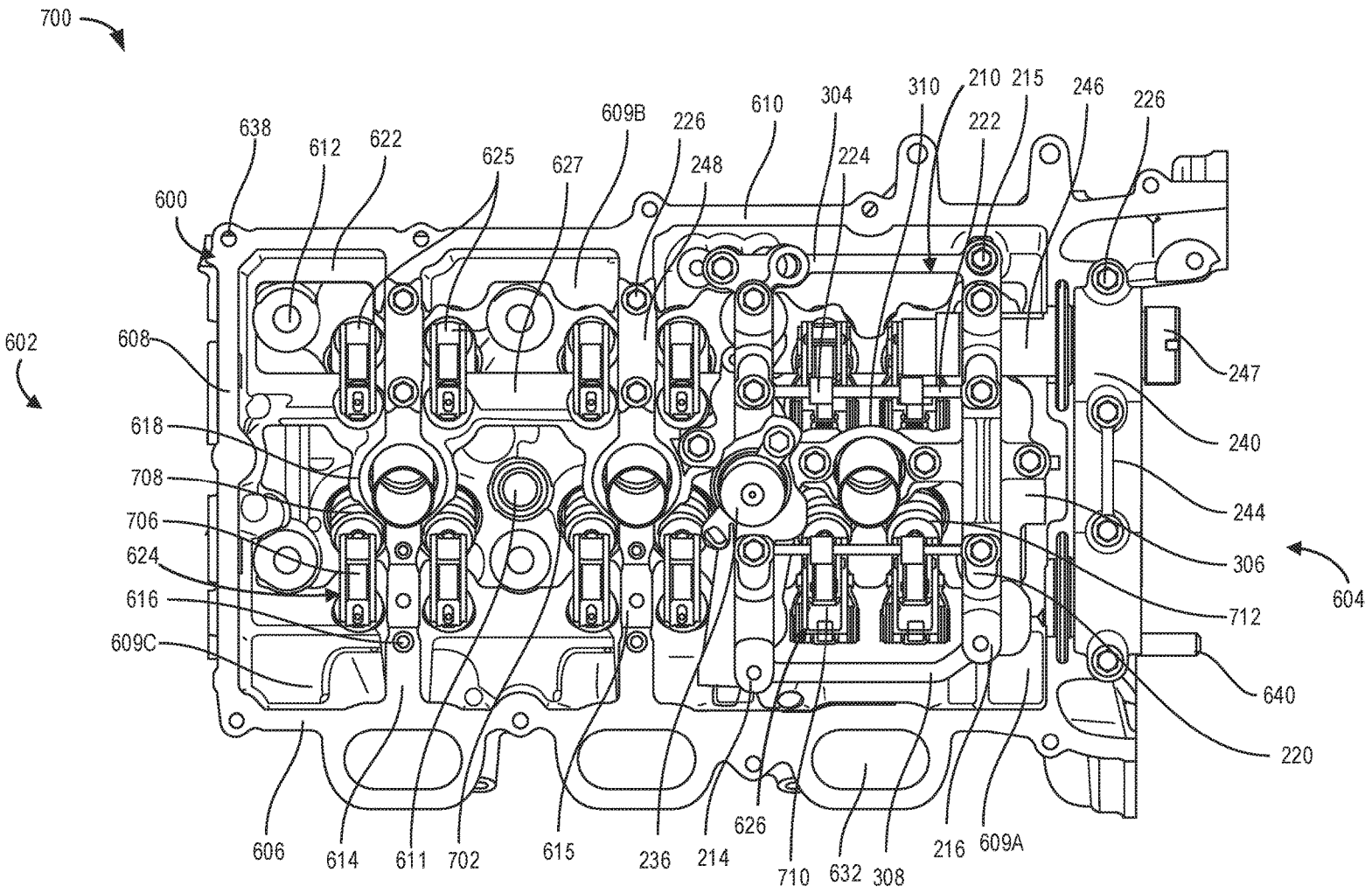
FIG. 7 shows a plan view of the second embodiment of the cylinder head, with the cam carrier insert mounted to the interior compartment of the cylinder head.
Figure 8:
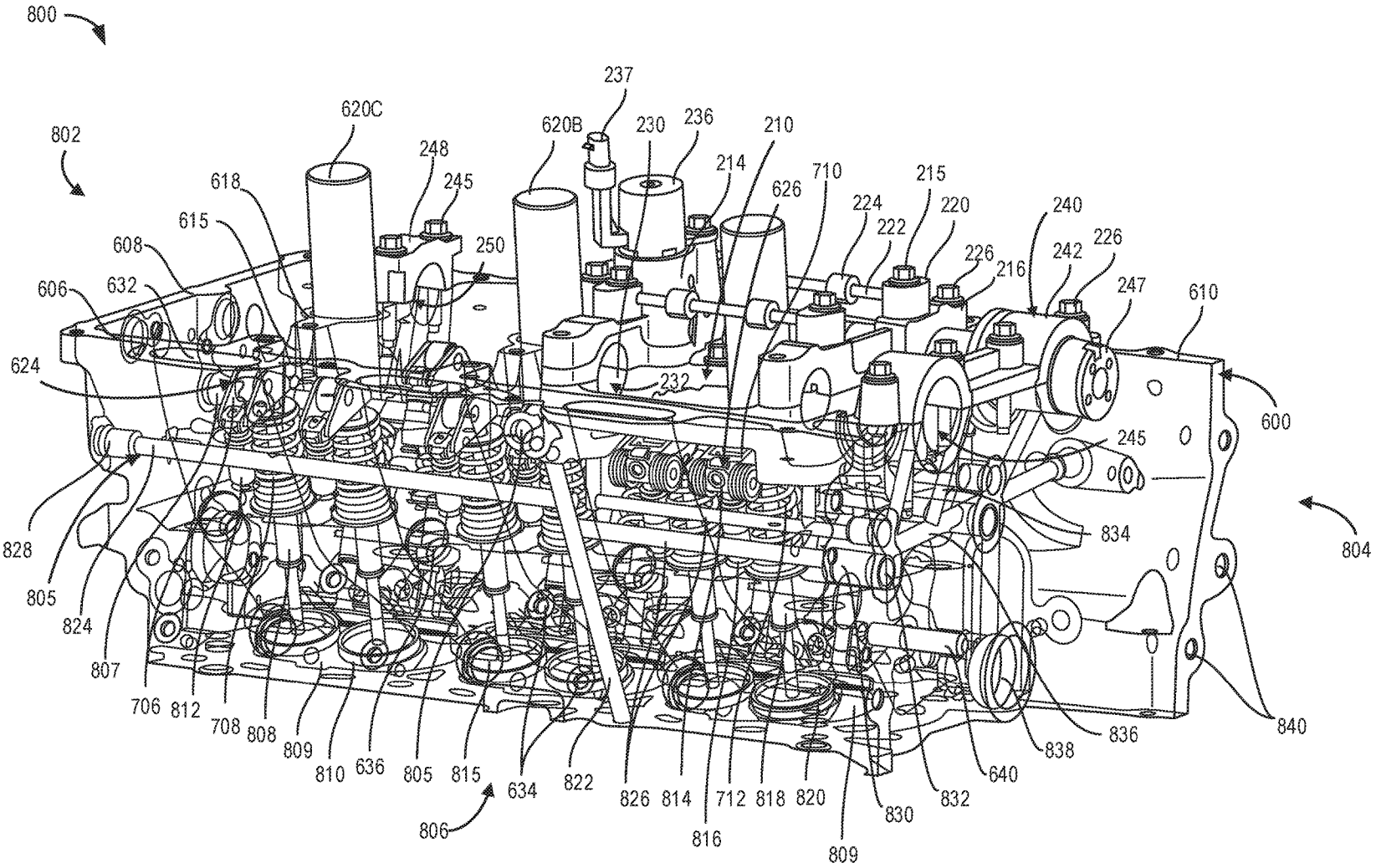
FIG. 8 shows a 3-D view of the second embodiment of the cylinder head, with the cam carrier insert, valve assemblies and oil supply circuit mounted to the cylinder head.
Figure 9:
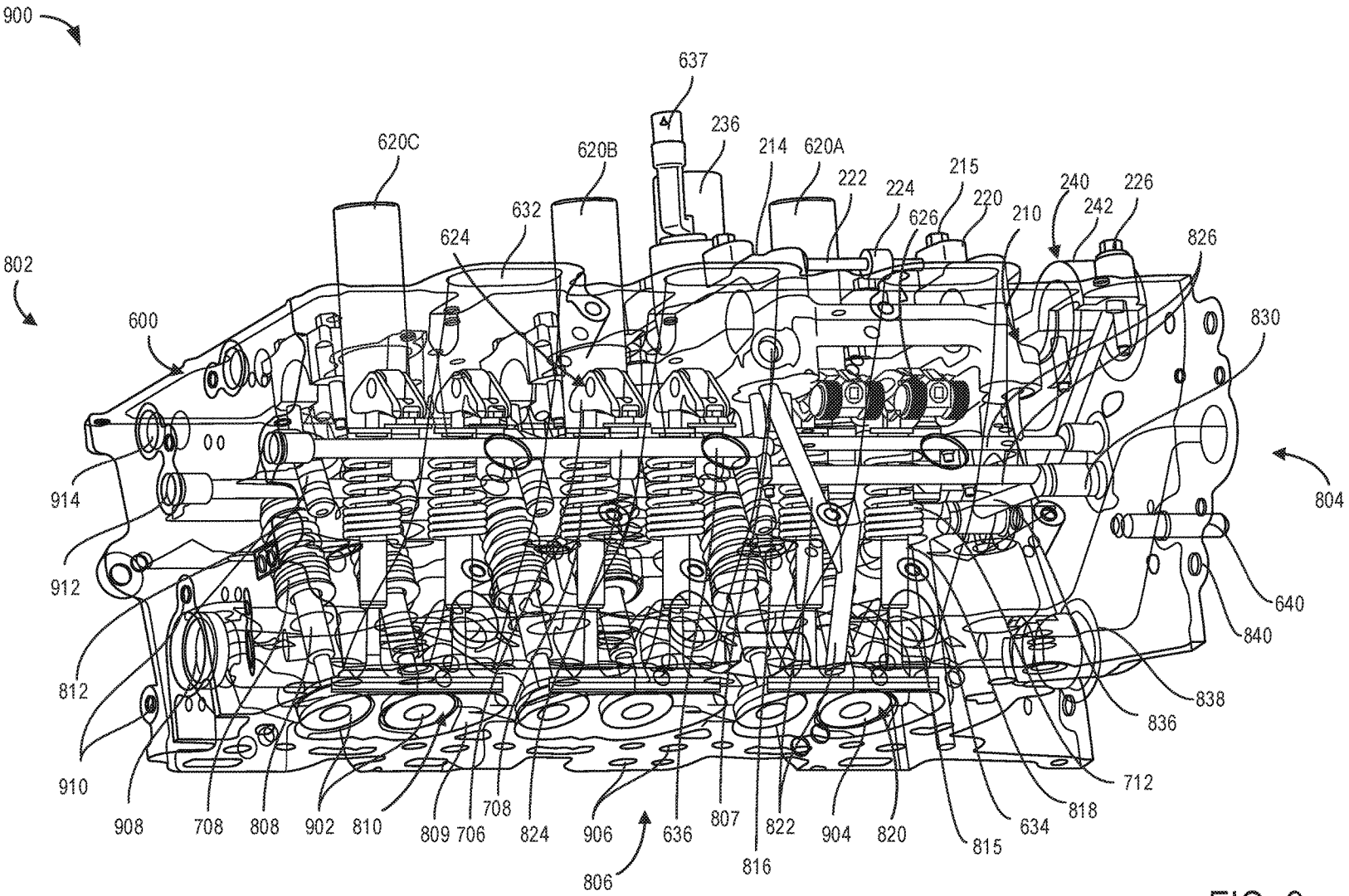
FIG. 9 shows an alternative 3-D view of the second embodiment of the cylinder head, with the cam carrier insert, valve assemblies and oil supply circuit mounted to the cylinder head.

FIGS. 6-9 show a second embodiment of a cylinder head including cam bearing towers, the cam carrier insert, VCT mechanism and other engine accessories except for the cylinder head cap. Both the cam bearing towers and cam carrier insert have bearing portions that support the cam shaft, as described earlier in FIGS. 2-5. Further, the second embodiment of the cylinder head may include an oil supply circuit and a plurality of openings for distributing fluids to various engine components, as shown in FIGS. 8-9. The oil supply circuit may include a plurality of rising lines, flow lines and a cross flow line. The rising lines may connect to the flow lines, which may connect to the cross flow line. One or more rising lines may connect to an oil supply source at the bottom of the cylinder head. The rising lines may also connect to openings in the cam carrier and VCT mechanism. In this way, cam carrier insert and VCT mechanism may receive engine oil from the oil supply circuit via the openings in the cam carrier and cylinder head.

Figure 10:
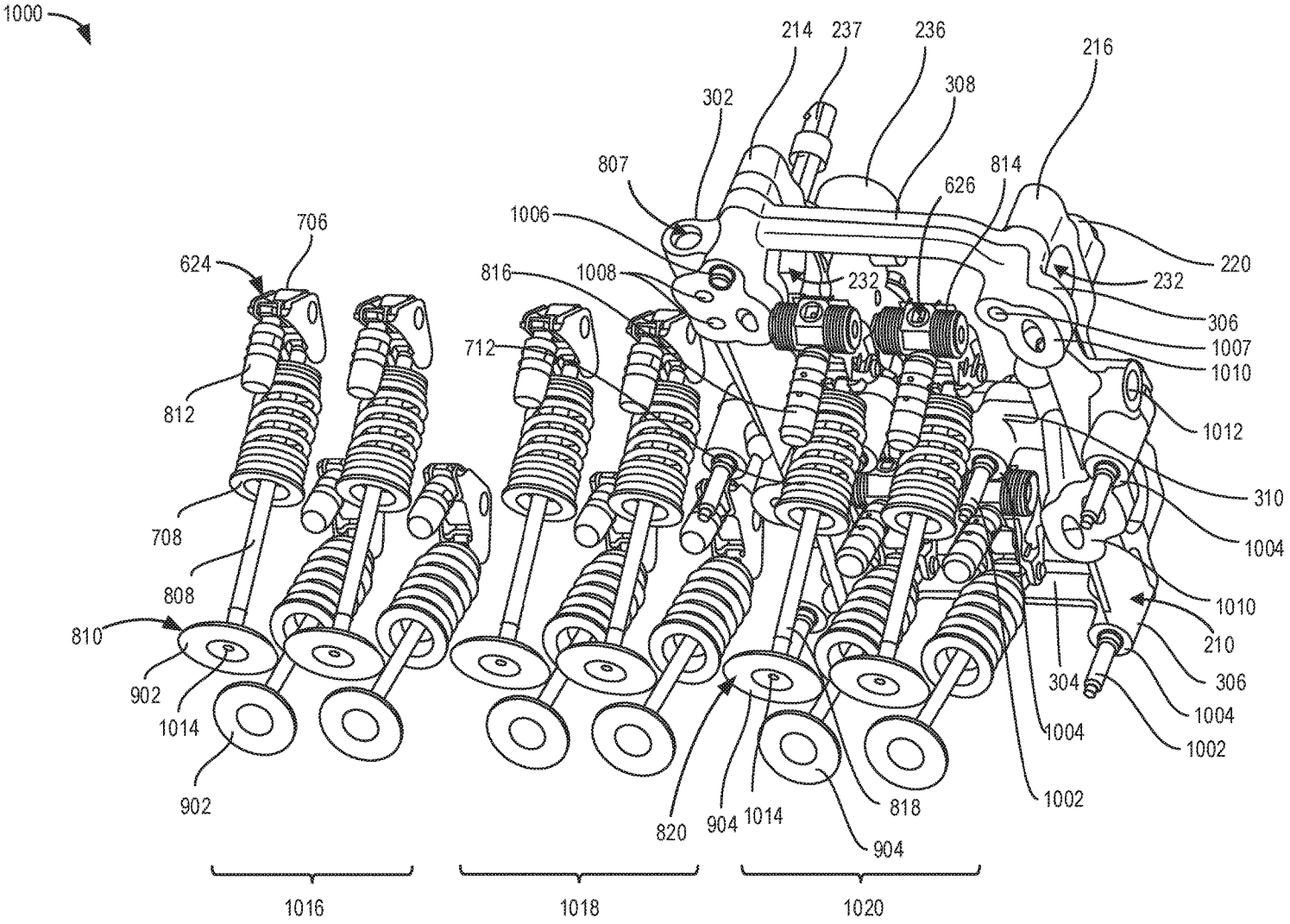
FIG. 10 shows a 3-D view of the cam carrier insert and valve assemblies of the engine.
Figure 11:
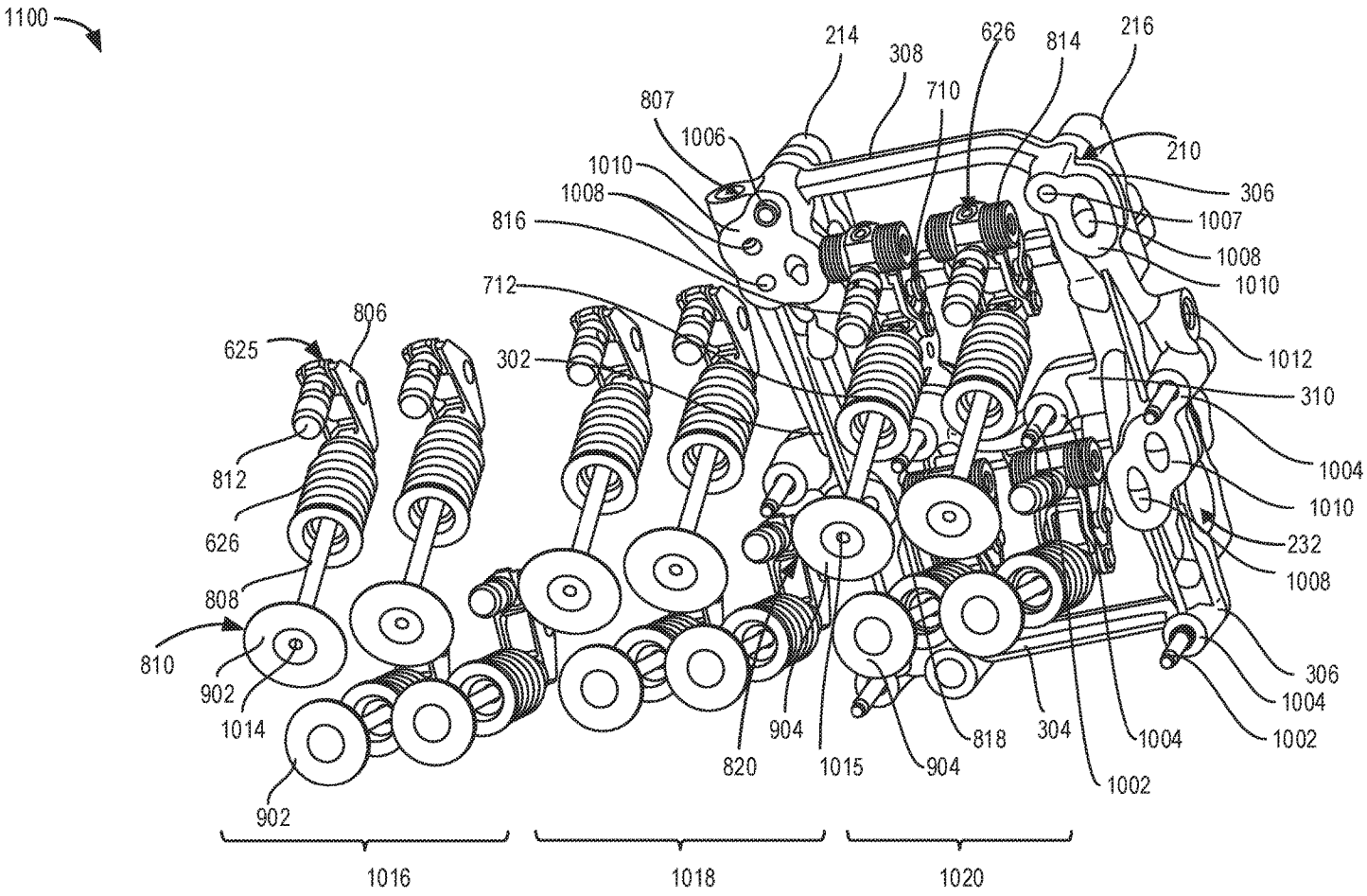
FIG. 11 shows an alternative 3-D view of the cam carrier insert and valve assemblies of the engine.

A first and a second three dimensional view of the cam carrier insert and a plurality of valve assemblies is shown in FIGS. 10-11, respectively. The plurality of valve assemblies may be used to control opening and closing of intake and exhaust ports in cylinders in the engine. The first and second group of valve assemblies may include non-deactivatable intake and exhaust valves of cylinders in the engine. The third group of valve assemblies may include deactivatable intake and exhaust valves of one or more cylinders in the engine. A bottom portion of the cam carrier insert includes a plurality of openings configured to connect to the rising lines of the oil supply circuit disclosed in FIGS. 8-9. As an example, engine oil may be supplied from an oil supply source and delivered to the cam carrier via the plurality of openings in the bottom portion of the cam carrier insert.

Referring to FIG. 1, a schematic depiction of an engine 100 used to provide motive power to a vehicle, for example. In the depicted example, the engine 100 includes a cylinder head 102 coupled to a cylinder block 104 forming a cylinder 106. The engine 100 is configured to implement combustion operation in a cylinder 106. An intake valve 108 is provided in the engine 100 to flow intake air into the cylinder 106 at selected time intervals. Correspondingly, an exhaust valve 110 is provided in the engine 100 to flow exhaust gas out of the cylinder 106 into a downstream exhaust system at selected time intervals. Although the engine 100 is depicted as having only a single cylinder, in other examples, the engine 100 may include more than one cylinder.

Arrow 112 represents the flow of intake air from upstream intake system components such as intake conduits, an intake manifold, a throttle, a compressor, etc., to the intake valve 108. On the other hand, arrow 114 represents the flow of exhaust gas to downstream components such as exhaust conduits, an exhaust manifold, emission control device(s), a turbine, etc., from the exhaust valve 110.

A fuel delivery system 116 is also provided in the engine 100. The fuel delivery system 116 is configured to provide fuel for combustion in the cylinder 106 at desired time intervals. The fuel delivery system 116 includes a direct injector 118, in the illustrated example, and upstream components 120. The upstream components 120, such as fuel pumps, valves, conduits, etc., are configured to provide fuel to the fuel injector 118. However, a port injector configured to deliver fuel into a conduit upstream of the cylinder may be additionally or alternatively included in the fuel delivery system 116. One of the fuel pump may be mounted to a cylinder head cap (not shown) secured to the cylinder head 102 via a plurality of fasteners as disclosed further below with reference to FIGS. 2-9. The engine 100 is configured to implement a four stroke combustion cycle in the engine. The combustion strokes include an intake stoke, a compression stroke, a combustion stroke, and an exhaust stroke, described in greater detail herein. An ignition device (not shown) may also be provided in the engine 100. The ignition device may be configured to provide spark to the cylinder 106 at selected time intervals. However, in other examples the ignition device may be omitted from the engine and the engine may be configured to perform compression ignition.

FIGS. 2-11 show a specific example with example implementation details. However, more generic designs and features may be referred to and/or used, if desired.

Turning to FIG. 2, a schematic depiction of a cam carrier insert 210 mounted to a first embodiment of a cylinder head 200 of an engine (such as engine 100 shown in FIG. 1) is disclosed. The cylinder head 200 may have an upstream side 202 and a downstream side 203. The cylinder head 200 may include a plurality of external walls 204-208 connected together to form an enclosed interior region of the cylinder head. A plurality of compartments 205 may be formed between any of the external walls 204-208 and a plurality of cam bearing towers 252. The cam bearing towers 252 may be formed in the interior region of the cylinder head 200. Each cam bearing tower 252 may connect to external walls 204 and 208, thereby dividing the interior region of the cylinder head into the plurality of compartments 205. As an example, the cam bearing towers 252 may be configured to support a cylinder head cap 254 and a plurality of cam shafts (not shown). When mounted to the cam bearing towers 252, the cam shaft may be secured in place by the cylinder head cap 254 coupled to the towers via plurality of fasteners 264. As an example, the cam shaft may be in face-sharing contact with a bearing portion 265 of each bearing tower 252. An opening 266 formed between the cylinder head cap 254 and each bearing tower 252, may be adequately sized to receive the cam shaft.

When mounted to the cylinder head 200, the cam carrier insert 210 may be rest within one or more compartments 205. The cam carrier insert 210 may be secured to the cylinder head via a plurality of fasteners 215 extended through openings (not shown) in each support member. As shown in FIG. 2, the cam carrier insert 210 may include bearing region 212 designed to support a variable displacement engine (VDE) cap 214 and an upper cam cap 216. The VDE cap 214 may be secured to the cam carrier insert 210 via a plurality of fasteners 226 extended through openings 217 in the VDE cap. The upper cam cap 216 may be secured to the cam carrier insert 210 via fasteners 226 extended through openings 228. When mounted to the cam carrier insert 210, an opening 232 may be formed between the VDE cap 214 and the cam carrier. Similarly, the upper cam cap 216 may be mounted to cam carrier insert 210 to form another opening 232. Each opening 232 may be adequately sized to receive a cam shaft extended across the cylinder head 200.

A plurality of cross members 222 may be coupled to the VDE cap 214 and upper cam cap 216 via fasteners 215 extended through openings (not shown) in mounting bosses 220 and VDE cap, and openings (not shown) in the mounting bosses 220 and upper cam cap 216. Each mounting boss 220 on the VDE cap 214 may be positioned in a recessed slot 221 formed on an outer surface of the VDE cap. The mounting bosses 220 on the upper cam cap 216 may be positioned in recessed slots 223 formed on an outer surface of the cam cap, and secured to the cam cap via fasteners 215. As an example, each fastener 215 may be a bolt and washer assembly that secures each mounting boss 220 (connected to the cross member 222) to the VDE cap 214 and upper cam cap 216. Each cross member 222 may include a plurality of rotatable elements 224 coupled to the member. The cross members 222 may act as bracing members that provide structural rigidity to the VDE cap 214 and upper cam cap 216. The upper cam cap 216 may also include a connecting member 219 positioned in a recessed portion 218 of the cam cap.

A solenoid valve 236, secured inside an annular tube 234 of the VDE cap 214, may provide a means of controlling deactivatable intake and exhaust valves of one or more cylinders (not shown) mounted in a cylinder block attached to the cylinder head 200. The solenoid valve 236 may include a vertical extended arm 237. A spark plug tube 238A, installed in an opening 239, may be adequately sized to receive a plug for igniting an air-fuel mixture in a cylinder having deactivatable intake and exhaust valves. In contrast, spark plug tubes 238B-C may be installed in openings 241 formed adjacent to the cam bearing towers. The spark plug tubes 238B-C may be adequately sized to receive spark plugs coupled to cylinders having non-deactivatable intake and exhaust valves.

A variable cam timing (VCT) cap 240 may be mounted at the downstream side 203 of the cylinder head 200. The VCT cap 240 may include a plurality of curved annular portions 242 and a cross member 244 formed between the curved annular portions 242. Each curved annular portion 242 may be a semi-circular shape that couples to the cylinder head 200 to form an opening 245. The opening 245 may include a bearing portion 243 adequately sized to receive a shaft 246. The shaft 246 may form a portion of a cam shaft extended through the opening 245. When installed in the opening 245, the shaft 246 may be in face sharing contact with the bearing portion 243, and a head section 247 of the shaft 246 may extend outward and away from the opening 245. An upstream portion of the shaft 246 may extend through the opening 232 formed between the upper cam cap 216 and the cam carrier insert 210. When extended through the opening 232, a portion of the shaft 246 may be in face-sharing contact with the bearing portion 230 on the cam carrier insert 210.

The plurality of cam caps 248 may be mounted to portions of the bearing towers 252, to form a plurality of openings 250. Each cam cap 248 may be secured to the bearing tower 252 via fasteners 226 extended through openings (not shown) in the cam cap and bearing tower. Each opening 250 may be adequately sized to receive a portion of the cam shaft extended across the cylinder head 200, for example. The cylinder head cap 254, coupled to the cam bearing towers 252 in the interior of the cylinder head 200, may provide a means of mounting a fuel pump (not shown). A raised portion 256 of the cylinder head cap 254 may include a main opening 260 to receive the fuel pump and a plurality of secondary openings 262 to receive fasteners (not shown) for securing the fuel pump to the cylinder head cap. As an example, the fuel pump may be mounted to the cylinder head cap 254 to provide fuel to cylinders in the engine. Although shown to be mounted adjacent to the upstream side 202 of the cylinder head 200, the cylinder head cap 254 may be mounted at other suitable positions on the cylinder head. The raised portion 256 of the cylinder head cap 254 may be connected to a lower portion 258 by welding, bolts or other suitable means of mechanical assembly. The cylinder head cap 254 may be mounted to the cam bearing towers 252 and secured using the plurality of fasteners 264 extended through openings (not shown) in the lower portion 258 of the head cap. As an example, the cylinder head cap 254 may be mounted to the cylinder head 200 using bolts, screws or other suitable means of mechanical assembly. When mounted to bearing towers 252, the lower portion 258 of the cylinder head cap 254 may form a plurality of openings 266 to receive a portion of the cam shaft. When the cam shaft is mounted through any of the openings 266, a portion of the cam shaft may be in face-sharing contact with bearing portions 265 on the cam bearing towers 252 of the cylinder head 200. The cam shaft may be further extended through openings 232 formed between the VDE cap 214, upper cam cap 216 and cam carrier insert 210.

The cylinder head 200 may also include a first set of openings 270-278 on a side portion 207 of the cylinder head. A second set of openings 280-284 may be formed on the downstream side 203 of the cylinder head 200. A dowel 275, secured to the downstream side 203 of the cylinder head 200, may provide a means of coupling the cylinder head to an engine assembly. A side portion 209 of the cylinder head 200 may include a plurality of web portions 288 having slots 290. Each web portion 288 may connect to the external wall 208 of the cylinder head 200.

In this way, the cam carrier insert 210 may be mounted to the cylinder head 200 to support the VDE cap 214 having the solenoid valve 236, and a portion of the cam shafts that controls valve assemblies coupled to the deactivatable cylinder. Further the cam carrier insert 210 may support the VCT cap 216 coupled to a valve control timing mechanism. A portion of the cam shaft that controls valves assemblies coupled to non-deactivatable cylinders in the engine, may be directly mounted to cam bearing towers 252 on the cylinder head 200. By mounting a portion of the cam shaft on the cam carrier insert 210, designated cylinders in the engine may be deactivated while non-deactivatable cylinders remain in operation. In this way, packaging of engine components within the cylinder head may be improved while promoting improved engine performance. Further, extensive machining of the cylinder head is not necessary because different engine architectures, such as VDE or an engine without VDE, may be achieved by inserting an appropriate cam carrier insert. For example, when a VDE architecture is desired the cam carrier insert would include deactivatable valves for the cylinders that would be shut down in a VDE operating mode. When a non-VDE architecture is desired, the cam carrier insert would include non-deactivatable valves.

Although described as being coupled to a specific cylinder, the cam carrier insert 210 may be used with any one cylinder or any combination of cylinders in the engine, for example. In other examples, the cam carrier insert 210 may be used in systems where cam journals are positioned over a cylinder head bolt. In this way, more room may be provided for other engine components such as valve train assemblies coupled to the cylinder head or other engine assembly. In further examples, the cam carrier insert 210 may be used in combination with a fuel pump or a variable valve lift system. In one example, a high pressure fuel pump for supplying fuel to one or more cylinders in the engine, may be mounted to the cam carrier insert 210. In this way, the cam carrier insert 210 may provide a means of adequately securing the fuel pump to the engine while providing bearing support to other engine components.

Referring to FIG. 3, a plan view 300 of the cylinder head 200 having the cam carrier insert 210 is disclosed. The cam carrier insert 210 may include a first member 302, a second member 304, a third member 306, a fourth member 308 and a bracing member 310. Each member 302-310 may be secured to a bottom portion of the cylinder head 200 via the plurality of fasteners 215 extended through openings (not shown) in each member.

As shown in FIG. 3, the first member 302 includes a linear portion 305 connected to a first annular portion 307 and a second annular portion 309. The first member 302 may be secured to the bottom portion of the cylinder head 200 via fasteners 215 extended through openings (not shown) in the first and second annular portions. Although not shown, the first member 302 includes a plurality of cam bearing portions (such as bearing portions 230 shown in FIG. 2). The second member 304 may include a linear portion 311, a third annular portion 313 and a fourth annular portion 315, the third annular portion 313 having an opening 225. The second member 304 may be coupled to the bottom portion of the cylinder head 200 via fastener 215 extended through an opening (not shown) in the fourth annular portion 315. The third member 306 may include a linear portion 317 and a side portion 319. The third member 306 may be coupled to the cylinder head 200 via fastener 215 extended through an opening (not shown) in the side portion 319 of the member. The linear portion 317 of the third member 306 may include cam bearing portions (such as bearing portions 230 shown in FIG. 2).

The fourth member 308 may be a linear portion having a curved section 321. The bracing member 310 may include a curved portion 323 formed adjacent to the spark plug tube 238A. The bracing member 310 may be secured to the cylinder head via fasteners 215 extended through openings (not shown) in the bracing member. The bracing member 310 may connect the first member 302 to the third member 306, to provide structural integrity to the cam carrier insert 210. The first, second, third and fourth members, including the bracing member may be connected together to form a single integral cam carrier insert having bearing portions that support a cam shaft extended across the cylinder head.

A plurality of openings 312 formed on the bottom portion of the cylinder head 200, may be adequately sized to receive valve assemblies (not shown) that may be coupled to valve components 314. An engine controller (not shown) may be coupled to the valve assemblies to control opening and closing of intake and exhaust ports in the engine cylinders. When the intake ports are open, air may be inducted into the cylinder, where the air mixes with fuel before combusting. Exhaust gases in the cylinder may be expelled via the exhaust ports. The cylinder head 200 may also include openings 316 and recessed apertures 318 to receive other engine components.

In this way, the cam carrier insert 210 may include a plurality of support members connected to one another, each support member coupled to the cylinder head 200 via the plurality of fasteners 215 extended through openings in each support member and the cylinder head. Further, the cam carrier insert 210 includes bearing portions configured to support portions of the cam shaft extended across the cylinder head 200. In this way, the cam carrier insert 210 may provide bearing support for portions of the cam shaft, while the remaining portions of the cam shaft not supported by the cam carrier may directly bear upon sections of the cylinder head 200, such as bearing portions 265 of the cam bearing towers 252 shown in FIG. 2.

Referring to FIG. 4, a cross sectional view 400 of the cylinder head 200 showing a partial section of the cam carrier insert 210 and a plurality of valve assemblies 403 is disclosed. The cross section view 400 is taken along a face 402 of the cylinder head 200, with a portion of the cam carrier insert 210 supporting the VCT cap removed.

The partial section of the cam carrier insert 210 shown in FIG. 4, includes the first member 302 connected to portions of the second member 304 and fourth member 308. A portion of the bracing member 310 is connected to the first member 302. The bracing member 310 may be securely fastened to the cylinder head 200 via fastener 215, which extends through an opening (not shown) formed in the member, with a distal end 415 of the fastener 215 extending outward. The VDE cap mounted on the first member 302, includes the solenoid valve 236 mounted in the annular tube 234 formed adjacent to a side mounting boss 407. The bearing portions 230 on the first member 302 of the cam carrier insert 210 may be semi-circular in shape. Each bearing portion 230 may be adequately sized to receive portion of a cam shaft extended through each opening 232 formed between the carrier and VCT cap 216. Further, each upper bearing portion 405 formed on the VCT cap 216, may form an upper portion of each openings 232. When the cam shaft is mounted in any of the openings 232, the bearing portion 230 and upper bearing portion 405 may make face contact with the cam shaft. In this way, portions of the cam shaft may be supported by the cam carrier insert 210, and securely fastened to the cylinder head 200 via fasteners 226.

Each valve assembly 403 may include a swing arm 404 connected to a valve rod 406 having a valve seat 410. The valve rod 406 may be enclosed by a spring 408 that wraps around the valve rod. A portion of each valve assembly 403 may be installed in an opening formed in annular portion 412 in an interior region of the cylinder head 200. When installed, the valve seat 410 of the valve rod 406 may rest inside a valve port 411 above a cylinder 414. The valve assemblies 403 may provide a means of controlling flow of air through intake ports in the cylinder 414, and flow of exhaust gas out of exhaust ports in the cylinder 414. A plurality of openings 416 formed on the face 402 of the cylinder head 200, may provide a means of supplying engine fluids to various engine components. The cylinder head 200 may also include a plurality of recessed slots 418 formed on the face 402.

Referring to FIG. 5, a cross sectional view 500 of the cylinder head 200 showing a partial section of the cam carrier insert 210 and valve assemblies 403 is disclosed. The cross section view 500 is taken along a face 502 of the cylinder head 200, with a portion of the cam carrier insert 210 supporting the VCT cap removed.

As shown in FIG. 5, the cam carrier insert 210 is mounted to an interior region of the cylinder head 200 via the plurality of fasteners 215 extended through the first member 302 and bracing member 310 of the carrier. Each valve assembly 403 may be installed inside the annular portion 412 formed in the interior region of the cylinder head 200. As an example, each valve assembly 403 may be positioned in compartments formed between support members of the cam carrier insert 210. In one example, a first pair of valve assemblies 504 may be positioned in a first compartment formed between the first member 302, second member 304 and bracing member 310. A second pair of valve assemblies 506 may be positioned in a second compartment formed between the first member 302, fourth member 308 and bracing member 310.

A plurality of primary slots 508 and secondary slots 510 may be formed on a side face 512 of the cylinder head 200. As an example, both the primary slots 508 and secondary slots may be adequately sized to convey engine fluids to various engine components. In other examples, each of the primary slots 508 may be larger than any of the secondary slots 510. Further, the cylinder head 200 may include a recessed slot 514 that allows a bottom portion of the cylinder head to attach to an engine assembly, such as the cylinder block.

Referring to FIG. 6, a schematic depiction of the cam carrier insert 210 mounted to a second embodiment of a cylinder head 600 of an engine (such as engine 100 shown in FIG. 1) is disclosed. The cylinder head 600 may have an upstream side 602, a downstream side 604, and side portions 605-607. The cylinder head 600 may include a plurality of external walls 606-610 connected together to form an enclosed interior region of the cylinder head. A plurality of compartments 609A-609C may be formed between the external walls 606-610 and a plurality of cam bearing towers 614 formed in the interior region of the cylinder head 600. Each bearing tower 614 may connect to external walls 606 and 610, thereby dividing the interior region of the cylinder head 600 into compartments 609A-609C. The compartments 609B-C may include recessed apertures 611-612 formed between internal wall 622 and a partition wall 627. The bearing towers 614 may be configured with bearing portions 615 to support a portion of a cam shaft (such as shaft 246), which may be secured to the cylinder head 600 using the plurality of cam caps 248 and fasteners 226. As an example, each cam cap 248 may be coupled to the cam shaft, and secured to the cylinder head 600 by extending each fastener 226 through an opening 616 in the bearing towers 614.

When mounted to the cylinder head 600, the cam carrier insert 210 may be positioned in compartment 609A, for example. In alternative examples, the cam carrier insert 210 may be positioned in other suitable locations within the cylinder head 600. The cam carrier insert 210 may be secured to the cylinder head 600 via the plurality of fasteners 215 extended through openings (not shown) in support members of the carrier, such as the first member 302, second member 304, third member 306 and bracing member 310 of the cam carrier. As shown in FIG. 6, the cam carrier insert 210 may include bearing areas configured to support the variable displacement engine (VDE) cap 214 and the upper cam cap 216. The VDE cap 214 may be secured to the cam carrier insert 210 via a plurality of fasteners 226 extended through openings 217 in the VDE cap. The upper cam cap 216 may be secured to the cam carrier insert 210 via fasteners 226 extended through openings 228. When mounted to the cam carrier insert 210, an opening 232 may be formed between the VDE cap 216 and the cam carrier insert. Similarly, the upper cam cap 216 may be mounted to the cam carrier insert 210 to form another opening 232. Each opening 232 may be adequately sized to receive a cam shaft extended across the cylinder head 600. When extended through the openings 232, the cam shaft may be in face-sharing contact with the bearing portions 230 on the cam carrier insert 210.

A plurality of cross members 222 may connect the VDE cap 214 to the upper cam cap 216 via fasteners 215 extended through openings (not shown) in mounting bosses 220 and the VDE cap 214, and openings (not shown) in the mounting bosses 220 and upper cam cap 216. Each mounting boss 220 on the VDE cap 214 may be positioned on a recessed slot on an outer top surface of the VDE cap. The mounting bosses 220 on the upper cam cap 216 may be positioned in recessed slots on an outer top surface of the cam cap, and secured to the cam cap via fasteners 215. Each fastener 215 may be a bolt and washer assembly used to secure each mounting boss connected to the cross member 222 to the VDE cap 216 and upper cam cap 216. Each cross member 222 may include a plurality of rotating elements 224 coupled to the member.

The cross members 222 may act as bracing members that provide structural rigidity to the VDE cap 214 and upper cam cap 216. The upper cam cap 216 may also include the connecting member 219 positioned in the recessed portion 218 of the cam cap.

The solenoid valve 236 may be secured inside the annular tube 234 of the VDE cap 214 to provide a means for operating deactivatable intake and exhaust valves of one or more cylinders (not shown) mounted in a cylinder block attached to the cylinder head 600. The solenoid valve 236 may include a vertical extended arm 237. A spark plug tube 620A may be installed in the opening 618A formed in the interior of the cylinder head 600, adjacent to the curved portion 323 of the bracing member 310. The spark plug tube 620A may be adequately sized to receive a spark plug for igniting an air fuel mixture in the deactivatable cylinder positioned below the cylinder head 600. In contrast, spark plug tubes 620B-620C may be installed in openings 618B-618C formed adjacent to the cam bearing towers 614. The spark plug tubes 620B-620C may be adequately sized to receive spark plugs coupled to cylinders having non-deactivatable intake and exhaust valves.

The variable cam timing (VCT) cap 240 may be mounted at the downstream side 604 of the cylinder head 600. The VCT cap 240 may include curved annular portions 242 and a cross member 244 formed between the curved annular portions 242. Each curved annular portion 242 may be semi-circular in shape, and may couple to the cylinder head 600 to form an opening 245. The opening 245 may be adequately sized to receive a portion of a cam shaft, such as shaft 246. When mounted to the cylinder head 600, the portion of the shaft 246 may be in facing sharing contact with the bearing portion 243 on the cylinder head 600, and a head section 247 of the shaft 246 may extend outward and away from the periphery of the opening.

An upstream portion of the shaft 246 may extend through the opening 232 formed between the upper cam cap 216 and the cam carrier insert 210. When extended through the opening 232, a portion of the shaft 246 may be in face-sharing contact with the bearing portions 230 in the cam carrier insert 210. The cam shaft may be extended further upstream to bearing towers 614, where the shaft may be supported by bearing portions 615. When supported by the bearing towers 614, a portion of the cam shaft may be in face-sharing contact with the bearing portions 615 on the towers. The plurality of cam caps 248 may be mounted to a top portion of the bearing towers 614 to form openings 650. Each cam cap 248 may be secured to the bearing tower 614 via fasteners 226 extended through openings (not shown) in the cam cap and bearing tower 614. Each opening 650 may be adequately sized to receive a portion of the cam shaft extended across the cylinder head 600.

The interior region of the cylinder head 600 may include a plurality of valve assemblies 624 and 626. Each valve assembly 624 may be installed in openings (not shown) formed adjacent to the bearing towers 614, and coupled to either internal walls 622 or partition wall 627. The valve assemblies 624 may include non-deactivatable intake and exhaust valves of cylinders mounted in a cylinder block (not shown) attached to the cylinder head 600. The valve assemblies 626 may be positioned in openings (not shown) in an interior region enclosed by the cam carrier insert 210 in the compartment 609A. The valve assemblies 626 may include deactivatable intake and exhaust valves of one or more cylinders (not shown) mounted in the cylinder block attached to the cylinder head 600.

The cylinder head 600 may include a first set of openings 632-636 on a side portion 607 of the cylinder head. A second set of openings 642-648 may be provided on the upstream side 602 of the cylinder head 200. A dowel 640, secured to the downstream side 604 of the cylinder head 600, may provide a means of coupling the cylinder head to an engine assembly. A side portion 609 of the cylinder head 600 may include a plurality of web portions 288 having slots 290. Each web portion 288 may connect to the external wall 610 of the cylinder head 600.

In this way, the cam carrier insert 210 may be mounted to the cylinder head 600 to support the VDE cap 214 having the solenoid valve 236, and a portion of the cam shaft that may be coupled to the valve assemblies 626 coupled to the deactivatable cylinder. Further the cam carrier insert 210 may support the VCT cap 216 coupled to a valve timing mechanism. A portion of the cam shaft that may be coupled to valve assemblies 624 coupled to the non-deactivatable cylinders, may be mounted to the cam bearing towers 614 on the cylinder head 600. By mounting a portion of the cam shaft on the cam carrier insert 210, deactivatable intake and exhaust valves of designated cylinders in the engine may be deactivated while non-deactivatable intake and exhaust valves of the remaining cylinders remain in operation. In this way, packaging of engine components within the cylinder head 600 may be improved while promoting engine efficiency.

Although described as being coupled to a specific cylinder, the cam carrier insert 210 may be used with any one cylinder or any combination of cylinders in the engine, for example. In further examples, the cam carrier insert 210 may be used in systems where cam journals are positioned over a cylinder head bolt. In this way, more room may be provided for other engine components such as valve train assemblies coupled to the cylinder head 600 or other engine assembly. In other examples, the cam carrier insert 210 may be used in combination with a fuel pump or a variable valve lift system. In one example, a high pressure fuel pump for supplying fuel to one or more cylinders in the engine, may be mounted to the cam carrier insert 210. In this way, the cam carrier insert 210 may provide a means of adequately securing the fuel pump to the engine while providing bearing support to other engine components.

Referring to FIG. 7, a plan view 700 of the cylinder head 600 having the cam carrier insert 210 is disclosed. The cam carrier insert 210 may include the first member 302, second member 304, third member 306, fourth member 308 and bracing member 310. Each member 302-310 may be secured to a bottom portion of the cylinder head 600 via the plurality of fasteners 215 extended through openings (not shown) in each member. The cylinder head 600 may also include openings 611 and recessed apertures 612 to receive other engine components.

As shown in FIG. 7, a plurality of openings 702-704 formed on the interior of the cylinder head 600, may be adequately sized to receive valve assemblies 624-626, respectively. The valve assemblies 624-626 may be adjusted by an engine controller to control intake of air into engine cylinders, and outflow of exhaust gas from the cylinders during engine operation. Each valve assembly 624 may include a swing arm 706 and a spring 708 enclosing a valve stem (such as valve rod 406 shown in FIGS. 4-5). The swing arm 706 of each valve assembly 624 may connect to the internal wall 613 (or partition wall 627) and the valve rod. As an example, the swing arm 706 may connect to the internal wall 613 or partition wall 627) via a bolt or other suitable means of mechanical assembly. The valve assemblies 624 may include non-deactivatable intake and exhaust valves of cylinders (not shown) mounted to the cylinder block attached to the cylinder head.

Similarly, each valve assembly 626 may include a swing arm 710 and a spring 712 enclosing a valve rod (such as valve rod 406 shown in FIGS. 4-5). The swing arm 710 of each valve assembly 626 may be connected to a bottom portion of the cylinder head 600 and a valve rod (e.g., valve rod 406 shown in FIGS. 4-5). As an example, the swing arm 710 may be connected to the bottom of the cylinder head 600 via a bolt or other suitable means of mechanical assembly. The valve assemblies 626 may include deactivatable intake and exhaust valves of one or more cylinders (not shown) mounted to the cylinder block attached to the cylinder head 600.

A cam shaft extended across the cylinder head 600, may be supported by the bearing portions 615 of bearing towers 614, and bearing portions on the cam carrier insert 210 (e.g., bearing portions 230 shown in FIG. 6). When mounted to the bearing towers 614, portions of the cam shaft may make contact with the valve assemblies 624, to control opening and closing of non-deactivatable valve ports (not shown) of a first group of cylinders. Another portion of the cam shaft may make contact with the valve assemblies 626, to control opening and closing of deactivatable valve ports of a second group of cylinders.

In this way, the cylinder head 600 includes cam bearing towers 614 configured with bearing portions 615 to support first portions of the cam shaft, and the cam carrier insert 210 having bearing portions configured to support second portions of the cam shaft. In this way, the second portions of the cam shaft adjacent to the cam carrier insert 210 may control the deactivatable intake and exhaust valves of the second group of cylinders while second portions of the cam shaft adjacent to the cam bearing towers may be control non-deactivatable intake and exhaust valves of the first group of cylinders in the engine.

Referring to FIGS. 8-9, a three dimensional view 800 and an alternative three dimensional view 900, respectively of the second embodiment of the cylinder head 600 is disclosed. The cylinder head 600 includes the cam carrier insert 210, valve assemblies 624-626 and an oil supply circuit 805 connected to various engine components. The oil supply circuit 805 may include a plurality of rising lines 822, flow lines 824-826, angled flow lines 834 and a cross flow line 836. The cam carrier insert 210 may include an opening 807 for receiving engine oil from the oil supply circuit 805. The cylinder head 600 may include an upstream end 802 and a downstream end 804. The downstream end 804 may include a plurality of openings 838-840.

As shown in FIG. 8, the oil supply circuit 805 may be fluidly connected to the cam carrier insert 210 via the plurality of rising lines 822. One or more of the rising lines 822 may be fluidly coupled to a fluid source positioned below a bottom face 806 of the cylinder head 600. The flow lines 824-826 may be fluidly coupled to the rising line 822, and may be configured to supply engine fluids, such as engine oil to various engine components. The rising line 822 may also be coupled to an opening (not shown) in the cam carrier insert 210. The flow line 824 may be connected to an annular plug 828 positioned adjacent to an upstream end 802 of the cylinder head 600. The flow line 826 may be connected to an annular plug 830 positioned adjacent to a downstream end 804 of the cylinder head 600. The annular plug 830 may have an opening 832 at the downstream end 804 of the cylinder head 600. The angled flow lines 834 of the oil supply circuit 805 may connect to the opening 245, which may support a portion of the cam shaft. In this case, shaft 246 may be lubricated by engine fluids supplied through the angled flow lines 834. Each angled flow line 834 may connect to the cross flow line 836 positioned across the interior of the cylinder head 600. The cross flow line 836 may connect to one of the flow lines 826 which connects to the rising line 822 leading to the oil supply source.

As shown in FIGS. 8-9, the valve assemblies 624-626 may be mounted to the cylinder head 600 to control opening and closing of intake and exhaust ports in cylinders 809 mounted in a cylinder block attached to the bottom face 806 of the cylinder head 600. The valve assemblies 624-626 may be adjusted to control intake of air into cylinders 809, and outflow of exhaust gas from cylinders 809 during engine operation. Each valve assembly 624 may include the swing arm 706, spring 708 enclosing a valve rod 808 connected to a valve seat 810 disposed in the cylinder 809. The swing arm 706 may also connect to a lash adjustor 812. Each valve assembly 624 may include non-deactivatable intake and exhaust valves of a first group of cylinders, for example.

Similarly, each valve assembly 626 may include the swing arm 710 and spring 712 enclosing a valve rod 818 connected to a valve seat 820 disposed in the cylinder 809. The swing arm 710 of each valve assembly 626 may connect to a lash adjustor 816 that may be coupled to an opening (e.g., opening 312 shown in FIG. 3) in the cylinder head 600. The valve assemblies 626 may include deactivatable intake and exhaust valves of a second group of cylinders mounted in the cylinder block as disclosed further below with reference to FIGS. 10-11. When adjusted to a closed valve position, as shown in FIG. 9, each inner surface 902-904 of each valve seat 810-820, may be disposed inside the cylinder 809. The bottom face 806 of the cylinder head 600 may include a plurality of openings to allow exchange of fluids between the cylinder head and block. The upstream end 802 of the cylinder head 600 may include a plurality of openings 910-914. The openings 912 may connect to the oil supply circuit 805 in the cylinder head 600.

Referring to FIGS. 10-11, a three dimensional view 1000 and an alternative three dimensional view 1100, respectively of the cam carrier insert 210 and valve assemblies 624-626, is disclosed. A first group of valve assemblies 1016 and a second group of valve assemblies 1018 may be positioned outside the cam carrier insert 210. A third group of valve assemblies 1020 may be positioned in an interior region enclosed by members 302-310 of the cam carrier insert 210.

The cam carrier insert 210 may be secured to a cylinder head (e.g., cylinder head 600 shown in FIGS. 6-9) via the plurality of fasteners 215 that may be extended through openings formed on the members 302-310 of the cam carrier. When mounted to the cylinder head, a rod shaped portion 1002 of each fastener 215 may extend into a slot formed on a bottom portion of the cylinder head, and an outer face 1004 of each member 302-310 may be in face-sharing contact with the bottom portion of the cylinder head. The cam carrier insert 210 may also include a plurality of openings 1008 formed on a bottom face 1010 of each member 302-310 of the carrier. The plurality of openings 1008 in the cam carrier insert 210 may connect to oil supply lines, such as rising lines 822 shown in FIGS. 8-9. The VDE cap 214 and VCT cap 216 may be secured to the cam carrier insert 210 via the plurality fasteners 226 that may extend into opening 1007 formed on the cam carrier, VDE and VCT caps. When installed in the opening 1007 in the VDE cap and cam carrier insert 210, a distal end 1006 of the fastener 226 may extend downward from the bottom portion 1010 of the cam carrier.

As shown in FIGS. 10-11, each of the first group of valve assemblies 1016 and second group of valve assemblies 1018 may include non-deactivatable intake and exhaust valves of a first and a second cylinder in the engine. The first and second group of valve assemblies include the plurality of valve assemblies 624, each valve assembly 624 having the swing arm 706 connected to the valve rod 808 which is enclosed by the spring 708. The swing arm 706 may be also connected to the lash adjustor 812. The valve seat 810, formed at a bottom portion of the valve rod 808, may include the inner face 902 having an opening 1014 which extends into the valve rod. The third group of valve assemblies 1020 may include deactivatable intake and exhaust valves of a third cylinder in the engine. The third group of valve assemblies 1020 includes the plurality of valve assemblies 626, each valve assembly 626 having the swing arm 710 connected to the valve rod 818 which is enclosed by the spring 712. The swing arm 710 may include the cylindrical portion 814 connected to the lash adjustor 816. The valve seat 820, formed at a bottom portion of the valve rod 818, may include the inner face 904 having an opening 1015 which extends into the valve rod. The third group of valve assemblies 1020 may be positioned in the interior region of cam carrier insert 210 to control opening and closing of intake and exhaust deactivatable ports in the third cylinder.

Turning back to FIG. 8, when mounted to the cylinder head 600, first portions of a cam shaft may be in face-sharing contact with the bearing portions 615 of bearing towers 614. Second portions of the cam shaft may be in face-sharing contact with the bearing portions 230 on the cam carrier insert 210. During engine operation, a portion of the cam shaft adjacent to the cam bearing towers 614 (and in contact with each valve assembly 624) may adjust a vertical position of the swing arm 706 by compressing the spring 708 and pushing the valve rod 808 in the interior of the cylinder 809 to open either the intake or exhaust ports of the first group of cylinders. Each intake or exhaust port may be closed by releasing the spring 708 and pushing the valve rod 808 upward.

The second portions of the cam shaft mounted on the bearing portions 230 of the cam carrier insert 210 may make contact with each valve assembly 626 (coupled to the deactivatable intake and exhaust ports of the second group of cylinders) to adjust a vertical position of the swing arm 709 and valve rod 818. By adjusting the vertical position of the swing arm 709 and valve rod 818, the deactivatable intake and exhaust ports of the second group of cylinders may be opened and closed during engine operation.

In this way, the cylinder head 600 includes the cam bearing towers 614 to support first portions of the cam shaft, and the cam carrier insert 210 having bearing portions 230 configured to support second portions of the cam shaft. By mounting second portions of the cam shaft on the cam carrier insert 210, sections of the cam shaft adjacent to the cam carrier insert 210 may control deactivatable intake and exhaust valves of the second group of cylinders while the first portions of the cam shaft adjacent to the cam bearing towers 614 may control non-deactivatable intake and exhaust valves of the first group of cylinders in the engine.

In one example, a system, comprises: a cylinder head with a cam bearing tower; a cam carrier insert positioned in the cylinder head; and a camshaft, the camshaft directly supported by the cam bearing tower and directly supported by the cam carrier insert. In the preceding example, additionally or optionally, the cam carrier insert is mounted directly to the cylinder head. In any or all of the preceding examples, additionally or optionally, the cam bearing tower is integral to, and monolithic with, the cylinder head. In any or all of the preceding examples, additionally or optionally, the camshaft is coupled to a variable displacement mechanism to disable one or more intake or exhaust valves of one or more cylinders coupled to the cylinder head. In any or all of the preceding examples, additionally or optionally, the cam bearing tower connects to side walls of the cylinder head to form a rigid support structure having bearing portions that support the cam shaft and a fuel pump pedestal. In any or all of the preceding examples, additionally or optionally, the system may further comprise a variable cam timing mechanism supported by a cam bearing tower of the cylinder head.

Furthermore, in any or all of the preceding examples, additionally or optionally, the cam bearing tower and the cam carrier insert include bearing portions that support a variable displacement engine mechanism, a variable control timing cap and the cam shaft. In any or all of the preceding examples, additionally or optionally, portions of the camshaft that connect to deactivatable valves are coupled to the cam carrier, whereas different portions of the camshaft that connect to non-deactivatable valves are coupled to the cam bearing tower of the cylinder head. In any or all of the preceding examples, additionally or optionally, the system further comprises a cylinder block coupled to the cylinder head. In any or all of the preceding examples, additionally or optionally, the system further comprises a cover coupled over the camshaft to enclose the camshaft and cam carrier to the cylinder head. In any or all of the preceding examples, additionally or optionally, the system further comprises a fuel pump mounted to the cylinder head.

Another example system, comprises: a cylinder head with a cam bearing tower; a cam carrier insert positioned in the cylinder head and offset asymmetrically to one side of the head; and a camshaft, the camshaft having first regions coupled directly to only bearing surfaces of the cam bearing tower and further having second, different, regions coupled directly to only surfaces of the cam carrier insert. In any or all of the preceding examples, additionally or optionally, the cam carrier is coupled between and interposed directly between the camshaft and the cylinder head, without any other components therebetween. In any or all of the preceding examples, additionally or optionally, there is no cam carrier coupled between the first region of the camshaft and the cylinder head.

In any or all of the preceding examples, additionally or optionally, the system further includes a variable cam timing mechanism supported by the cam bearing tower of the cylinder head. In any or all of the preceding examples, additionally or optionally, the system further includes an upper cap coupled to the cam carrier insert to securely fasten the cam shaft to the cylinder head. In any or all of the preceding examples, additionally or optionally, the cam carrier insert includes bearing portions that support a variable displacement engine mechanism to disable one or more intake or exhaust valves of one or more cylinders coupled to the cylinder head. In any or all of the preceding examples, additionally or optionally, the variable displacement engine mechanism includes a solenoid valve. In any or all of the preceding examples, additionally or optionally, the first regions of the camshaft connect to non-deactivatable valves in the cylinder head, and the second regions of the camshaft connect to deactivatable valves in the cylinder head.

An alternative example system comprises: a cylinder head with a cam bearing tower; a cam carrier insert positioned in the cylinder head and offset asymmetrically to one side of the head; a variable displacement engine mechanism coupled to the cam carrier insert; and a variable cam timing mechanism coupled to the cam bearing tower of the cylinder head. FIGS. 1-11 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a cylinder head with a cam bearing tower;

a cam carrier insert positioned in the cylinder head; and a camshaft, the camshaft directly supported by the cam bearing tower of the cylinder head and directly supported by the cam carrier insert, where the cam carrier insert is positioned between the camshaft and the cylinder head.

2. The system of claim 1, wherein the cam carrier insert is mounted directly to the cylinder head.

3. The system of claim 1, wherein the cam bearing tower is integral to, and monolithic with, the cylinder head.

4. The system of claim 1, wherein the camshaft is coupled to a variable displacement mechanism to disable one or more intake or exhaust valves of one or more cylinders coupled to the cylinder head.

5. The system of claim 1, wherein the cam bearing tower connects to side walls of the cylinder head to form a rigid support structure having bearing portions that support the camshaft and a fuel pump pedestal.

6. The system of claim 1, further comprising a variable cam timing mechanism supported by the cam bearing tower of the cylinder head.

7. The system of claim 1, wherein the cam bearing tower and the cam carrier insert include bearing portions that support a variable displacement engine mechanism, a variable control timing cap, and the camshaft.

8. The system of claim 1, wherein portions of the camshaft that connect to deactivatable valves are coupled to the cam carrier insert, whereas different portions of the camshaft that connect to non-deactivatable valves are coupled to the cam bearing tower of the cylinder head.

9. The system of claim 1, further comprising a cylinder block coupled to the cylinder head.

10. The system of claim 1, further comprising a cover coupled over the camshaft to enclose the camshaft and the cam carrier insert onto the cylinder head.

11. The system of claim 1, further comprising a fuel pump mounted to the cylinder head.

12. A system, comprising:

a cylinder head with a cam bearing tower;

a cam carrier insert positioned in the cylinder head and offset asymmetrically to one side of the cylinder head; and a camshaft, the camshaft having first regions coupled directly to only bearing surfaces of the cam bearing tower and further having second, different, regions coupled directly to only surfaces of the cam carrier insert, the cam carrier insert coupled between the camshaft and the cylinder head.

13. The system of claim 12, wherein the cam carrier insert is interposed directly between the camshaft and the cylinder head, without any other components therebetween.

14. The system of claim 12, wherein the cam carrier insert is not coupled between the first regions of the camshaft and the cylinder head.

15. The system of claim 12, further comprising a variable cam timing mechanism supported by the cam bearing tower of the cylinder head.

16. The system of claim 12, further comprising an upper cap coupled to the cam carrier insert to securely fasten the camshaft to the cylinder head.

17. The system of claim 12, wherein the cam carrier insert includes bearing portions that support a variable displacement engine mechanism to disable one or more intake or exhaust valves of one or more cylinders coupled to the cylinder head.

18. The system of claim 17, wherein the variable displacement engine mechanism includes a solenoid valve.

19. The system of claim 12, wherein the first regions of the camshaft connect to non-deactivatable valves, and the second regions of the camshaft connect to deactivatable valves in the cylinder head.

20. A system, comprising:

a cylinder head with a cam bearing tower;

a cam carrier insert positioned in the cylinder head and offset asymmetrically to one side of the cylinder head;

a variable displacement engine mechanism coupled to the cam carrier insert;

a variable cam timing mechanism coupled to the cam bearing tower of the cylinder head; and a camshaft directly supported by the cam bearing tower of the cylinder head and directly supported by the cam carrier insert, the cam carrier insert positioned between the camshaft and the cylinder head.

* * * * *